US005450298A

United States Patent [19]

Fells et al.

[11] Patent Number: 5,450,298

[45] Date of Patent: Sep. 12, 1995

[54] TRUCK/BUS DRIVER'S TOOL

[76] Inventors: Cedric H. Fells, 1815 Garfield Dr., Little Rock, Ark. 72204; Roy G. Burnley, 7205 Woodson Rd., Little Rock, Ark. 72209

[21] Appl. No.: 328,274

[22] Filed: Oct. 4, 1994

[51] Int. Cl.[6] ..... F21L 1/00

[52] U.S. Cl. ..... 362/139; 362/398; 362/202

[58] Field of Search ..... 362/108, 119, 138, 139, 362/157, 202, 208, 253, 398; 73/146

[56] References Cited

U.S. PATENT DOCUMENTS

| | | | |
|---|---|---|---|
| D. 342,178 | 12/1993 | Shih . | |
| 998,021 | 7/1911 | Marcy | 362/139 |
| 2,137,881 | 11/1938 | Margulies | 362/202 |
| 2,260,639 | 10/1941 | Powell | 362/208 |
| 2,475,958 | 7/1949 | Goodrich | 362/398 |
| 2,852,979 | 9/1958 | Hund . | |
| 3,004,474 | 10/1961 | Hund . | |
| 3,539,800 | 11/1970 | Doring . | |
| 3,713,614 | 1/1973 | Taylor | 362/398 |
| 3,843,981 | 10/1974 | Verest . | |
| 3,852,839 | 12/1974 | Blessing . | |
| 4,050,107 | 9/1977 | Parma . | |
| 4,628,418 | 12/1986 | Chabria | 362/398 |
| 4,739,457 | 4/1988 | Orr | 362/202 |
| 4,970,894 | 11/1990 | Huang . | |
| 5,086,377 | 2/1992 | Roberts | 362/253 |

*Primary Examiner*—Stephen F. Husar
*Assistant Examiner*—Sara Sachie Raab
*Attorney, Agent, or Firm*—Richard C. Litman

[57] ABSTRACT

A tool for allowing bus or truck drivers to inspect the tires and brakes on their vehicles, to determine whether or not their vehicles comply with applicable regulations and/or safety practices. The tool has in one integral unit a flashlight, an inspection mirror, a tire knocker, a tire tread depth gauge, a digital clock, a magnetic support, and a window closer.

18 Claims, 5 Drawing Sheets

TRUCK/BUS DRIVER'S TOOL

BACKGROUND OF THE INVENTION

1. Field of the Invention

The present invention relates to a compound tool for operators of vehicles such as trucks or buses, having in one integral unit a flashlight, an inspection mirror, a tire knocker, a tire tread depth gauge, a digital clock, a magnetic support, and a window closer.

2. Description of the Prior Art

The Department of Transportation (DOT) has, in the interest of safety, set forth strict requirements regarding permissible tire tread depth, proper tire inflation, and permissible level of wear on the brake pads. Drivers whose vehicles are not in compliance with these regulations risk substantial fines if their vehicles are stopped by authorities for any reason. Therefore, drivers routinely inspect their vehicles to ensure that they are in compliance with DOT regulations before travelling on the roadways.

For example, because the safety of school children is of paramount importance, school bus drivers are required to inspect their vehicles to ensure that the levels of tire and brake wear are within tolerable limits, and that all the tires are fully inflated. In addition, school bus drivers are required to close all the bus windows when parking their buses at the bus depot. School bus drivers find it much more convenient to walk around the outside of the vehicle and close all the windows from the outside, than to walk between the bus seats in order to close all the windows from the inside. Therefore, it would be highly desirable to provide truck or bus drivers with a handy and convenient tool that allows them to efficiently accomplish the inspection of their vehicle prior to travelling on the roadways. Further, it would be desirable for the tool to allow school bus drivers to close the bus windows from the outside.

In the prior art, various tools have been proposed that can accomplish certain individual tasks that are required as part of a complete vehicle inspection. However, no single tool has been proposed that allows a driver to accomplish the complete inspection of his vehicle in an efficient manner.

U.S. Pat. No. 4,970,894, issued to Huang, shows a combination tire pressure gauge and tire tread depth gauge. The Huang tool has no facility for inspecting brake pads.

U.S. Pat. No. 4,050,107, issued to Parma, shows a tire knocker with an axially slidable hook at one end. The Parma tool has no facility for inspecting brake pads or determining if the tire tread depth is within tolerable limits.

U.S. Pat. No. 3,852,839, issued to Blessing, shows a combination tool including a tire pressure gauge, a valve stem removing tool, and a hubcap removing tool. The Blessing tool has no facility for inspecting brake pads or determining if the tire tread depth is within tolerable limits.

U.S. Pat. No. 3,843,981, issued to Verest, shows a tire knocker in the shape of a baseball bat, having a hook at one end. The Verest tool has no facility for inspecting brake pads or determining if the tire tread depth is within tolerable limits.

U.S. Pat. No. 3,539,800, issued to Doring, shows a flashlight with a retractable magnet on the side of the flashlight body. The Doring flashlight has no mirror to allow inspection of the brake pads, and no facility for ascertaining whether or not the tires are road worthy.

U.S. Pat. No. 3,004,474, issued to Hund, shows a round inspection mirror hinged to the end of an elongated rod. U.S. Pat. No. 2,852,979, also issued to Hund, shows a rectangular inspection mirror hinged to the end of an elongated bar. These devices lack an illumination means, and have no facility for ascertaining whether or not the tires on a bus or truck are road worthy.

U.S. Pat. No. D. 342,178, issued to Shih, shows a flashlight holder having an integral clock and an integral thermometer, that can be hung on a wall. The Shih design shows a flashlight and a digital clock as separate items and lacks an inspection mirror, a tire knocker, and a tire tread depth gauge.

None of the above inventions and patents, taken either singly or in combination, is seen to describe the instant invention as claimed.

SUMMARY OF THE INVENTION

The present invention is a tool for allowing bus or truck drivers to inspect the tires and brakes on their vehicles, to determine whether or not their vehicles comply with applicable regulations and/or safety practices. The tool is in the form of an elongated cylinder having a flashlight portion at one end and an impacting portion, for use as a tire knocker, at the other end. A retractable inspection mirror and a window closer are provided at the end of the flashlight portion located distally from the impacting portion. A tire tread depth gauge is provided at the end of the impacting portion located distally from the flashlight portion.

Accordingly, it is a principal object of the invention to provide a convenient means for bus or truck drivers to ensure that the tire tread depth and the amount of brake pad wear on their vehicles is within the limits specified by the regulations.

It is another object of the invention to provide a convenient means for truck and bus drivers to quickly determine whether or not both tires in a dual tire arrangement are fully inflated.

It is a further object of the invention to provide school bus drivers with a convenient means for closing bus windows from the outside.

Still another object of the invention is to provide in a single conveniently carried tool all the means necessary to conduct a pre-operation check of a truck or bus.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
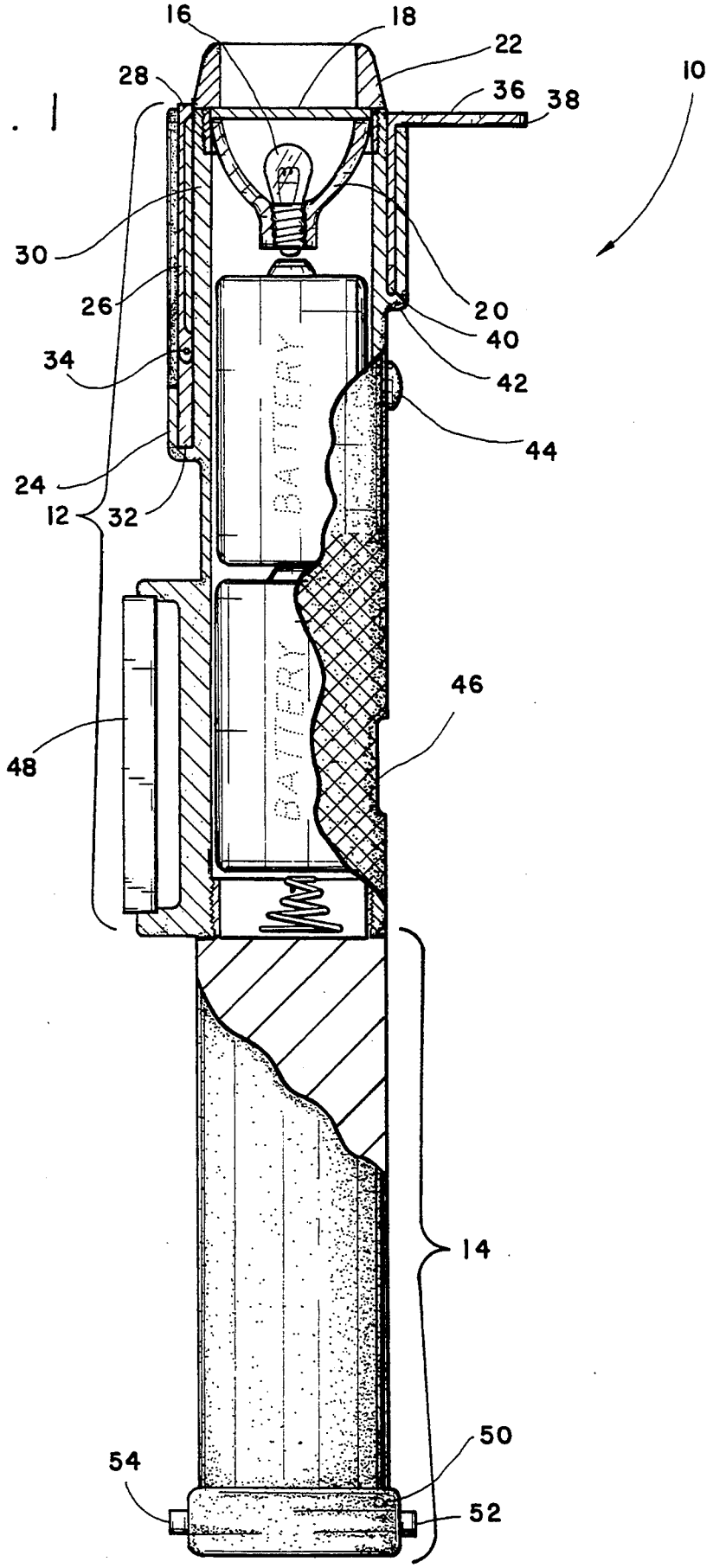
FIG. 1 is a side elevational view of the present invention partially broken away to reveal internal detail.

Referring to FIG. 1, the present invention is a compound tool 10 for allowing bus or truck drivers to inspect the tires and brakes on their vehicles. The tool 10 includes a flashlight portion 12, and an impacting portion 14. Both the flashlight portion and the impacting portion are preferably molded from high impact plastic. The flashlight portion 12 is in the form of an elongated, hollow cylindrical case, having first and second ends. The interior of the hollow cylindrical case forms a cavity dimensioned and configured to house a light assembly and batteries for powering the light assembly. The first end of the flashlight portion 12 is provided with an opening leading to the hollow interior of the flashlight portion. The light assembly is housed adjacent to the opening in the first end of the flashlight portion and includes a light bulb 16, a lens 18, and a parabolic reflector 20. The opening at the first end of the flashlight portion 12 is threaded to receive the retaining ring 22 which serves to secure the light assembly within the first end of the flashlight portion 12. A substantial portion of the outer surface of the flashlight portion 12 is knurled to allow a better grip when the tool 10 is being used as a tire knocker, in a manner explained below.

Adjacent the opening at the first end of the flashlight portion 12 is the mirror housing 24. The mirror housing 24 extends from the opening at the first end of the flashlight portion, along the outside of the flashlight portion, for a distance sufficient to allow the mirror assembly 26 and the mirror base 32 to be housed within the mirror housing 24 when the mirror assembly 26 is in the stowed position as shown.

The mirror assembly 26 includes a frame portion 28 and a reflective portion 30, and is hingedly attached to the mirror base 32. The reflective portion 30 is preferably made of a rectangular piece of glass which is silvered on the back. Alternatively the reflective portion 30 can be formed by metallizing the surface of the frame portion 28. The frame portion 28 is hingedly secured to the mirror base 32 via hinge pin 34.

Also adjacent the opening at the first end of the flashlight portion 12, on the side of the flashlight portion opposite the side on which the mirror housing 24 is located, there is provided a window closer 36. The window closer 36 is comprised of first member 38 and second member 40. The second member 40 is embedded in boss 42 in order to secure the window closer 36 to the tool 10. The first member 38 projects from the side of the tool 10, adjacent the first end of the flashlight portion 12, radially outward from the longitudinal axis of the tool 10. In operation, the first member 38 is used to catch a portion of a bus window frame in order to allow the vehicle operator to apply enough force to lower and close the bus window from outside the vehicle.

Located on the outside of the flashlight portion 12, closer to the middle of the flashlight portion than the boss 42, is a switch 44 for turning the bulb 16 on and off. Also on the outside of the flashlight portion 12, located closer to the second end of the flashlight portion than the switch 44, is a digital clock 46. No details of the switch 44 and the digital clock 46 are shown since such articles are well known. Digital clocks such as the digital clock 46 are generally powered by their own miniature battery cell housed within the digital clock itself.

On the outside of the flashlight portion 12, located on the side opposite the digital clock 46, is a magnetic support 48 for removably fixing the tool 10 to metal surfaces. The magnetic support 48 allows the user's hands to be free when necessary. In addition, the magnetic support 48 provides a convenient way to store the tool 10 in a readily accessible place by attaching the tool 10 to a conveniently located metal surface.

The impacting portion 14 is in the shape of an elongated cylinder having first and second ends. The flashlight portion 12 has an opening at its second end. The opening at the second end of the flashlight portion is internally threaded to receive the first end of impacting portion 14. The impacting portion 14 acts as a closure for the opening at the second end of the flashlight portion 12, and can be unscrewed from the second end of the flashlight portion 12 in order to allow the batteries housed in the flashlight portion to be accessed for replacement. The impacting portion 14 is of such mass and construction so as to allow bus or truck tires to be impacted with sufficient force to allow the vehicle operator to ascertain whether or not the tire is properly inflated by the sound of the impact. This feature is especially useful in the case of dual truck or bus tires, because in a dual tire arrangement there is no visible evidence of a flat if only one of the two tires is flat. In the preferred embodiment the impacting portion 14 is solid. However, it is not strictly necessary for the impacting portion to be solid as long as the impacting portion is of sufficient mass to accomplish its intended function. Further, although the flashlight portion and the impacting portion are shown as separate parts, the tool 10 can be of unitary construction with the batteries housed in the flashlight portion being accessed through the opening at the first end of the flashlight portion for replacement.

A tire tread depth gauge 50 is provided at the second end of the impacting portion 14. The gauge 50 has two cylindrical projections 52 and 54. The projections 52 and 54 are of different lengths, and correspond in length to the minimum permissible tire tread depth for various vehicles. By inserting either projection 52 or 54 into the grooves in the tire treads, the vehicle operator can tell at a glance whether the treads on his vehicle's tires are of sufficient depth.

Figure 2:
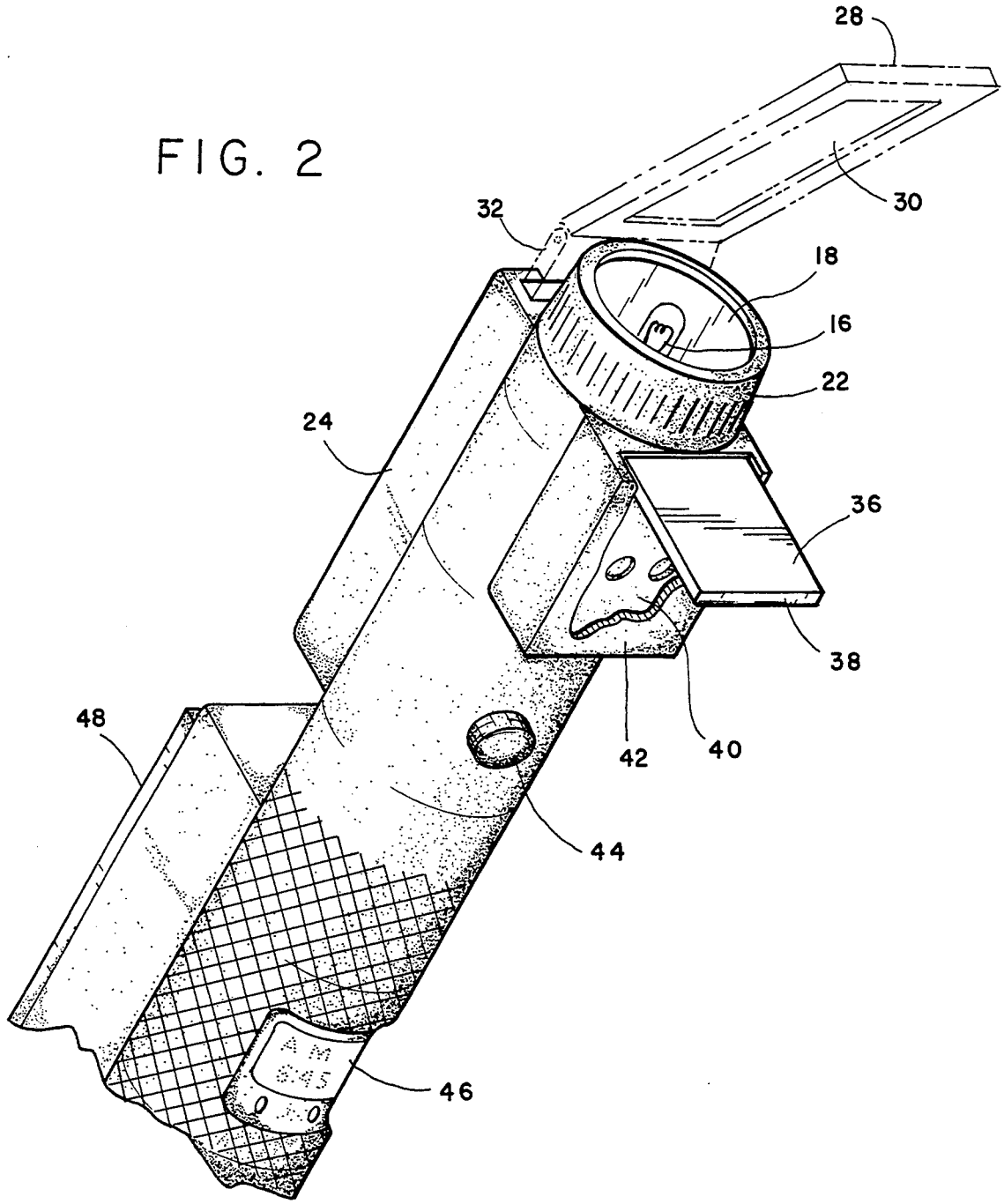
FIG. 2 is a perspective view of the present invention partially broken away to reveal internal detail of the window closing tool.

FIG. 2 shows in phantom lines the mirror assembly 26 in the use position. In this position the reflective surface of the reflective portion 30 is at an angle of 60° from the lens 18. In the use position the mirror assembly 26 allows light from the light assembly to be directed into openings in the brake housing (not shown) on the wheels of trucks or buses, thus illuminating the brake pads within the brake housing. The vehicle operator can then view the brake pads in the mirror assembly 26 in order to determine whether or not the brake pads need replacement.

Figure 3:
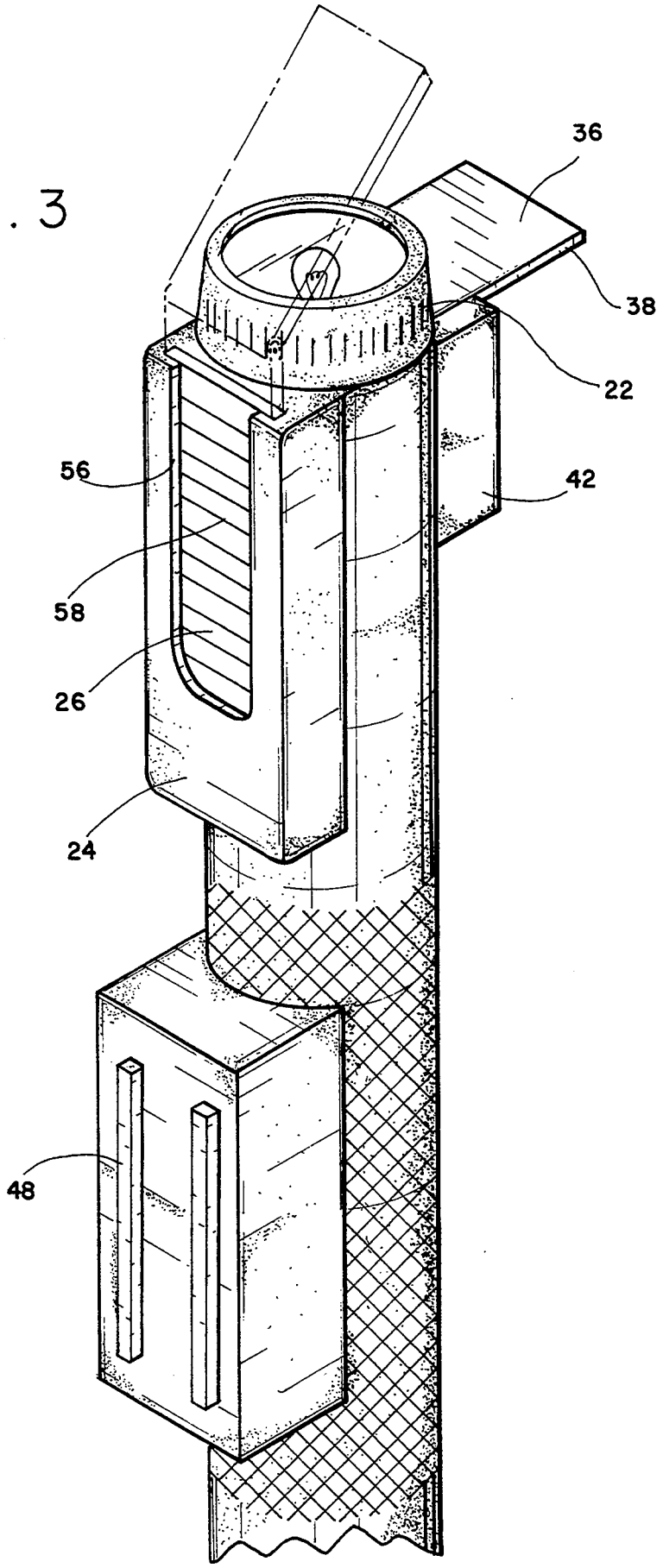
FIG. 3 is a perspective view of the present invention showing detail of the back of the mirror housing.

FIG. 3 shows detail of the back side of the mirror housing 24. The thumb slot 56 allows the mirror assembly 26 to be urged out of the mirror housing 24 under thumb pressure. The ridges 58 on the back of the mirror assembly 26 provide better frictional contact between the users thumb and the mirror assembly 26. Once fully extended, the mirror assembly 26 can be angled toward the lens 18 by rotating the mirror assembly about the hinge pin 34. Stops (not shown) on the mirror base 32 prevent the mirror base from sliding completely out of the mirror housing 24. Although an arrangement where the mirror assembly slides in and out of the mirror housing is shown, it is to be understood that many other arrangements for moving the mirror assembly between the stowed and use positions, such as allowing for the mirror assembly to fold in and out of the mirror housing, can be used without departing from the spirit and scope of the invention.

Figure 4:
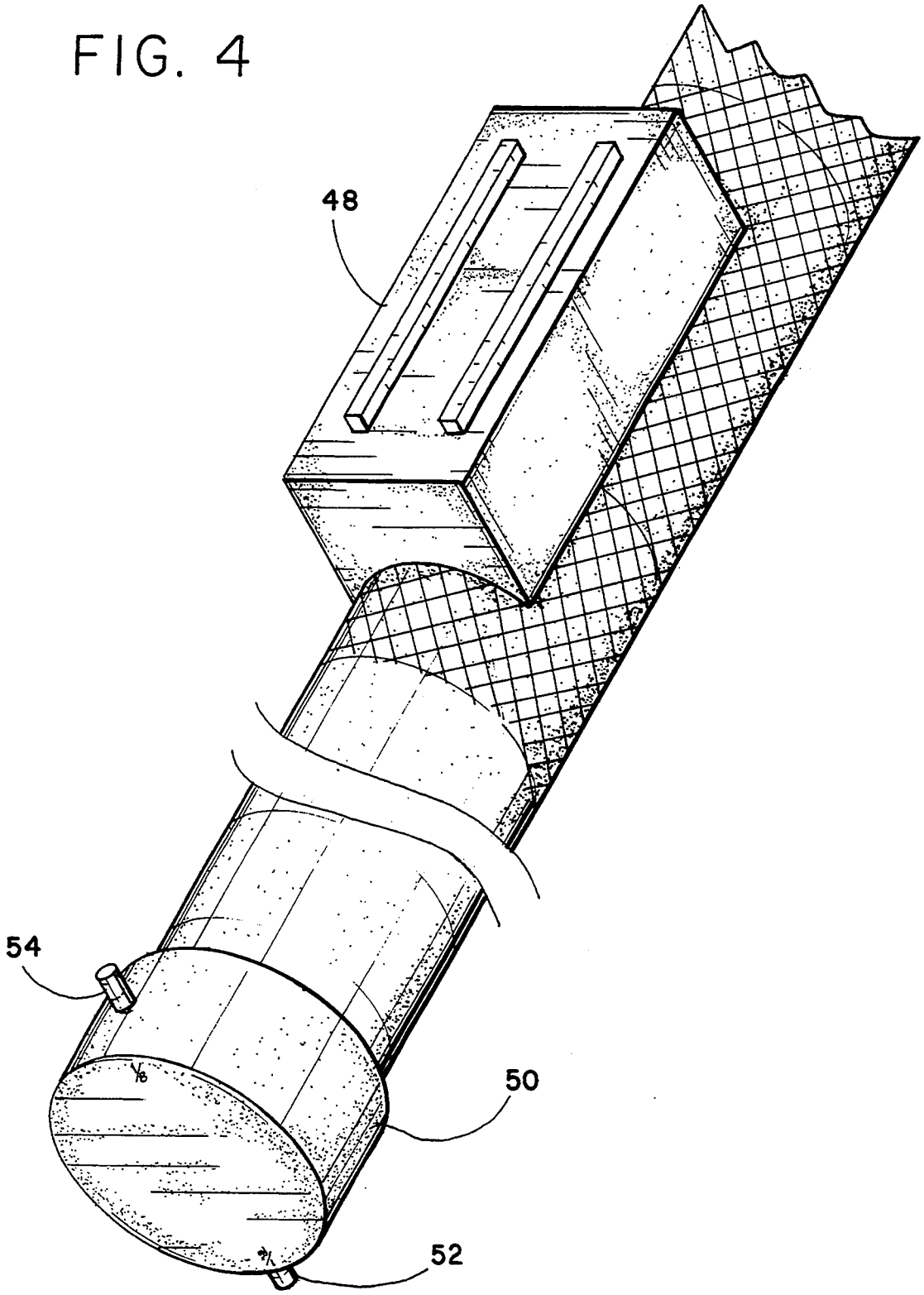
FIG. 4 is a partial perspective view of the present invention showing detail of the tire tread depth gauge.

FIG. 4 shows a perspective view of the tire tread depth gauge 50. The gauge 50 preferably has indicia on the bottom surface indicating the length of projections 52 and 54. The projections 52 and 54 are preferably made to extend in opposite directions about the second end of the impacting portion 14.

Figure 5:
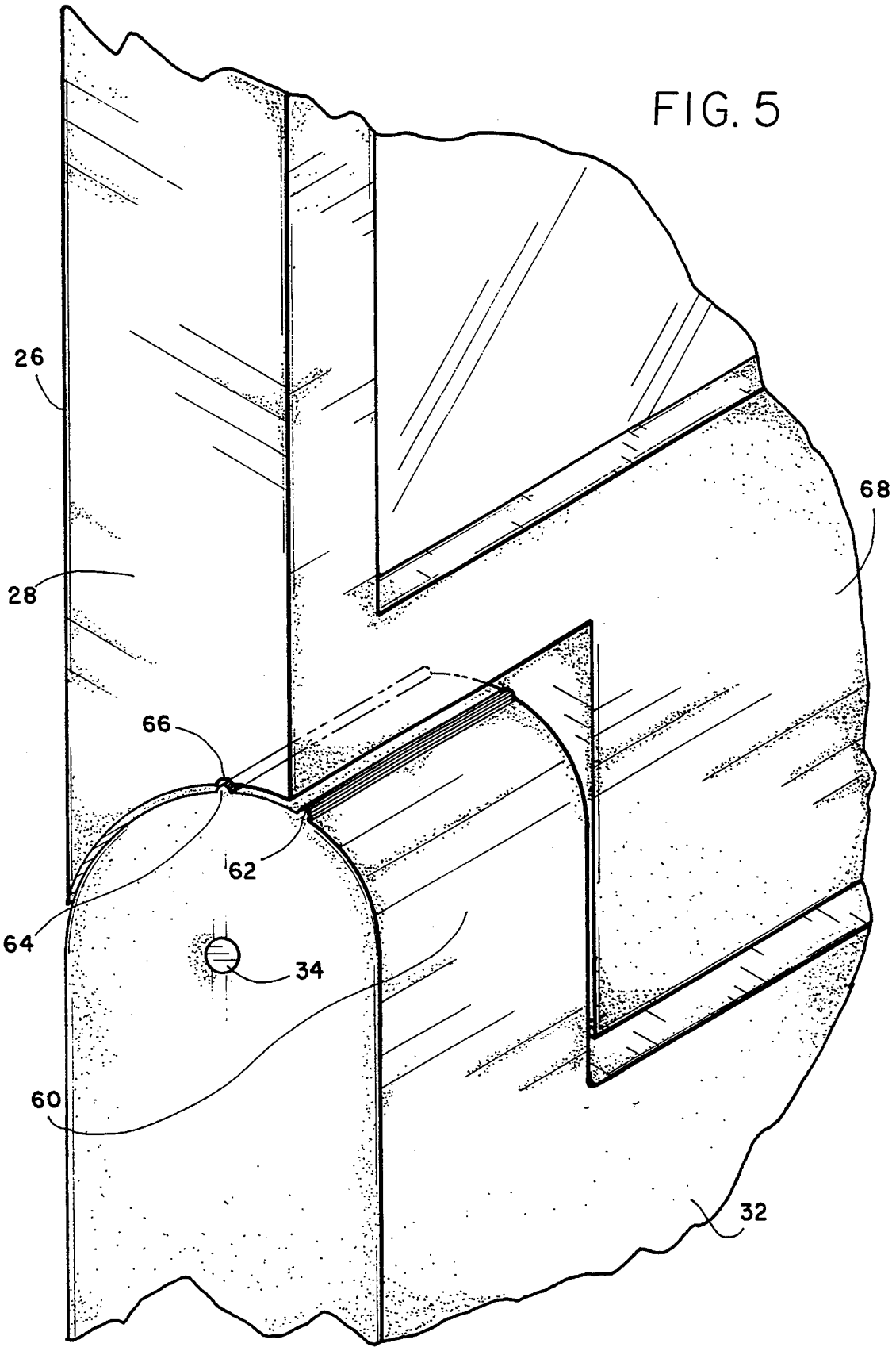
FIG. 5 is a partial perspective view of the present invention showing detail of the mirror hinge.

FIG. 5 shows details of the hinge between the mirror base 32 and the mirror assembly 26. The mirror base 32 has a first boss 60 and a second boss (not shown) symmetric with the boss 60, projecting therefrom. The frame portion 28 of the mirror assembly 26 has a male projection 68 which fits between the first and second bosses projecting from the mirror base 32. The hinge is formed by the hinge pin 34 passing through the first boss 60, the male projection 68, and the second boss symmetric with the boss 60. Since the structure of the hinge around the second boss is a mirror image of the structure of the hinge around the boss 60, only the structure of the hinge around boss 60 will be discussed. The boss 60 has ridges 62 and 64 which matingly engage the groove 66 in the frame portion 28 of the mirror assembly 26. The ridges 62 and 64 serve to lock the mirror assembly 26 at angles of 60° and 90° from the lens 18 respectively. The frame portion 28 of the mirror assembly is sufficiently resilient to allow the groove 66 to slide over ridges 62 and 64 when sufficient force is applied by the user. Thus the user can move the mirror assembly 26 between the 90° position and the 60° position.

It is to be understood that the present invention is not limited to the sole embodiment described above, but encompasses any and all embodiments within the scope of the following claims.

We claim:

1. A vehicle operator's tool comprising:

an elongated flashlight portion having first and second ends, said first end of said flashlight portion having an opening leading to an interior cavity;

a light assembly disposed within said interior cavity adjacent the opening in said first end of said flashlight portion;

a mirror assembly, juxtaposed the opening in said first end of said flashlight portion, displaceable from a stowed position to a use position disposed beyond the opening in said first end of said flashlight portion; and an elongated impacting portion having first and second ends, said impacting portion being of substantially greater mass than said flashlight portion and said first end of said impacting portion being attached to said second end of said flashlight portion;

whereby said mirror assembly when displaced to said use position may be used to visually access components beneath a vehicle as illuminated by said light assembly while said impacting portion may be used as a tire knocker to check a vehicle tire's integrity.

2. The vehicle operator's tool according to claim 1, further including:

a tire tread depth gauge disposed at said second end of said impacting portion and having first and second cylindrical projections, whereby one of said first cylindrical projection and said second cylindrical projection may be inserted into a groove in a tire tread having a depth in order to check that the tire tread depth is greater than a selected minimum corresponding to respective lengths of the first or second cylindrical projection.

3. The vehicle operator's tool according to claim 1, further including:

a switch disposed on an outside surface of said flashlight portion, selectively operable to turn the light assembly on and off.

4. The vehicle operator's tool according to claim 1, further including:

a window closer disposed adjacent the opening in said first end of said flashlight portion, said window closer having a projecting member whereby a portion of a vehicle window frame may be engaged in order to close a vehicle window.

5. The vehicle operator's tool according to claim 1, further including:

a magnetic support disposed on an outside surface of said flashlight portion, whereby said tool may be removably fixed to metal surfaces.

6. The vehicle operator's tool according to claim 1, further including:

a digital clock disposed intermediate said first and second ends of said flashlight portion.

7. The vehicle operator's tool according to claim 1, further including:

a retaining ring matingly engaged to the opening in said first end of said flashlight portion whereby said light assembly is secured within said cavity.

8. The vehicle operator's tool according to claim 1, further comprising means for removably attaching said first end of said impacting portion to said second end of said flashlight portion.

9. The vehicle operator's tool according to claim 1, further comprising means for disposing said mirror assembly at an angle of 60° from a plane defined by the opening in said first end of said flashlight portion.

10. The vehicle operator's tool according to claim 1, further including:

a mirror base attached to said mirror assembly by a hinged attachment; and a mirror housing juxtaposed the opening in said first end of said flashlight portion, said mirror housing containing said mirror assembly and said mirror base when the mirror assembly is in the stowed position, and said mirror housing being configured to allow said mirror assembly and a portion of said mirror base to slide out of said mirror housing, whereby said mirror assembly may pivot about said hinged attachment.

11. The vehicle operator's tool according to claim 10, further including:

a tire tread depth gauge disposed at said second end of said impacting portion and having first and second cylindrical projections, whereby one of said first cylindrical projection and said second cylindrical projection may be inserted into a groove in a tire tread having a depth in order to check that the tire tread depth is greater than a selected minimum corresponding to respective lengths of the first or second cylindrical projection.

12. The vehicle operator's tool according to claim 10, further including:

a switch disposed on an outside surface of said flashlight portion, selectively operable to turn the light assembly on and off.

13. The vehicle operator's tool according to claim 10, further including:

a window closer disposed adjacent the opening in said first end of said flashlight portion, said window closer having a projecting member whereby a portion of a vehicle window frame may be engaged in order to close a vehicle window.

14. The vehicle operator's tool according to claim 10, further including:

a magnetic support disposed on an outside surface of said flashlight portion, whereby said tool may be removably fixed to metal surfaces.

15. The vehicle operator's tool according to claim 10, further including:

a digital clock disposed intermediate said first and second ends of said flashlight portion.

16. The vehicle operator's tool according to claim 10, further including:

a retaining ring matingly engaged to the opening in said first end of said flashlight portion whereby said light assembly is secured within said cavity.

17. The vehicle operator's tool according to claim 10, further comprising means for removably attaching said first end of said impacting portion to said second end of said flashlight portion.

18. The vehicle operator's tool according to claim 10, further comprising means for disposing said mirror assembly at an angle of 60° from a plane defined by the opening in said first end of said flashlight portion.

* * * * *